United States Patent [19]

Nazem

[11] Patent Number: 4,480,977

[45] Date of Patent: Nov. 6, 1984

[54] APPARATUS FOR CONTROLLING THE CROSS-SECTIONAL STRUCTURE OF MESOPHASE PITCH DERIVED FIBERS

[75] Inventor: Faramarz Nazem, Strongsville, Ohio

[73] Assignee: Union Carbide Corporation, Danbury, Conn.

[21] Appl. No.: 474,474

[22] Filed: Mar. 11, 1983

Related U.S. Application Data

[62] Division of Ser. No. 215,412, Dec. 11, 1980, Pat. No. 4,376,747.

[51] Int. Cl.[3] ..... B28B 17/00

[52] U.S. Cl. ..... 425/192 S; 425/197; 425/467

[58] Field of Search ..... 425/467, 192 S, 197; 264/108, 29.2

[56] References Cited

U.S. PATENT DOCUMENTS

| | | | |
|---|---|---|---|
| 3,074,104 | 1/1963 | Stanley | 18/8 |
| 3,421,181 | 1/1969 | Steuber | 18/8 |
| 4,010,229 | 3/1977 | Pleaska et al. | 264/140 |
| 4,057,610 | 11/1977 | Goettler et al. | 264/108 |
| 4,272,577 | 6/1981 | Lyng | 264/108 |

FOREIGN PATENT DOCUMENTS

| | | | |
|---|---|---|---|
| 45-34479 | 11/1970 | Japan | 264/108 |
| 664099 | 1/1952 | United Kingdom | 425/464 |

*Primary Examiner*—Jay H. Woo
*Assistant Examiner*—Michael McGurk
*Attorney, Agent, or Firm*—David Fink

[57] ABSTRACT

A mesophase pitch derived fiber having a predetermined cross-sectional structure is produced by passing mesophase pitch being spun into a pitch fiber through a porous body positioned in the spinnerette channel of a spinnerette.

5 Claims, 11 Drawing Figures

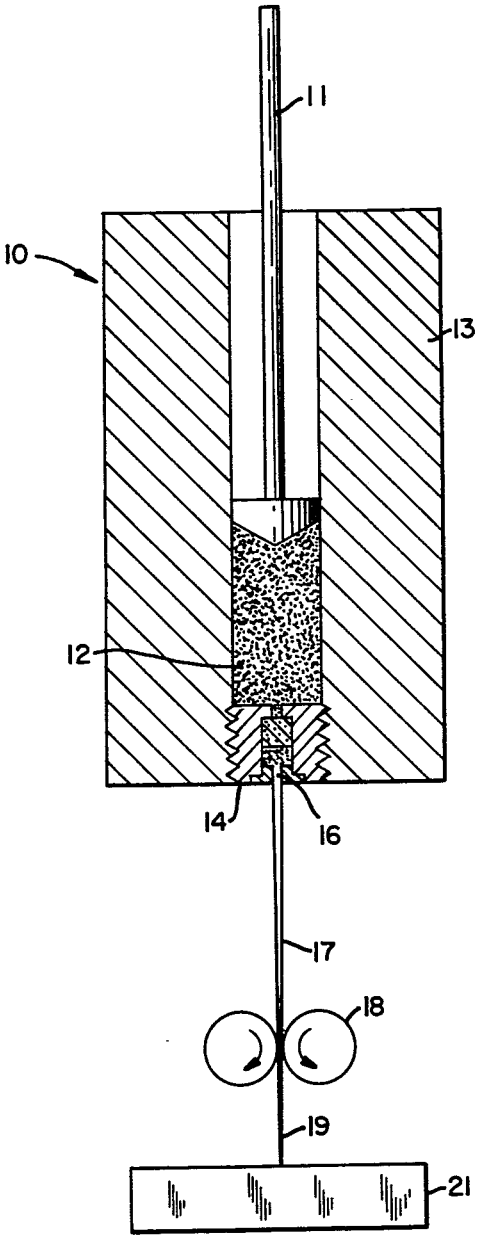
FIG. 1
FIG. 2A
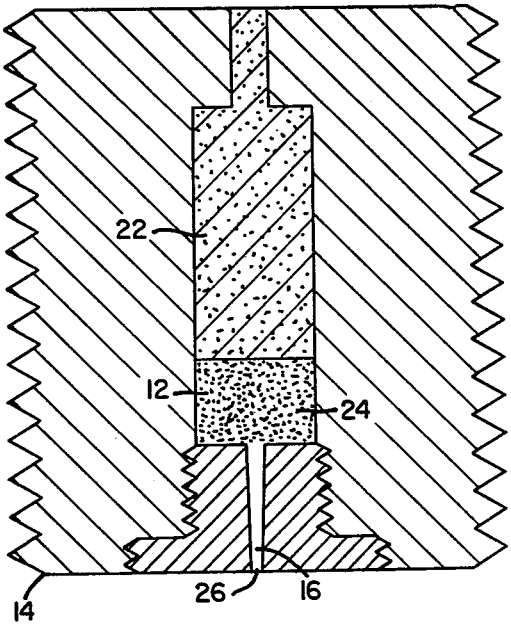
FIG. 2B
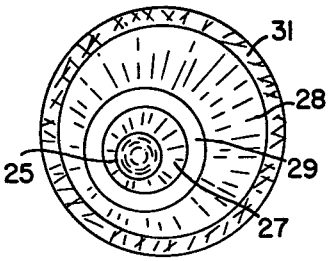

FIG. 3C
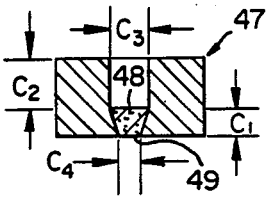
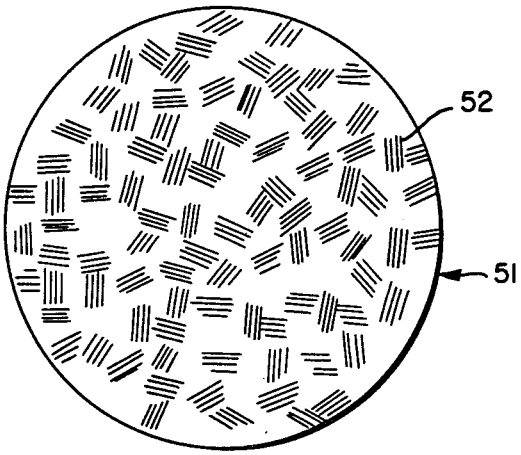
FIG. 4C
FIG. 3D
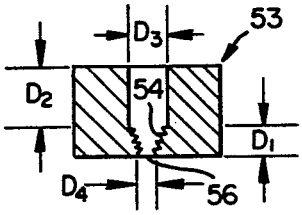
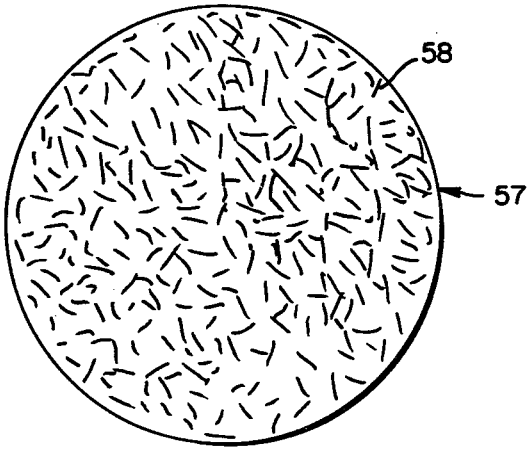
FIG. 4D

APPARATUS FOR CONTROLLING THE CROSS-SECTIONAL STRUCTURE OF MESOPHASE PITCH DERIVED FIBERS

This application is a division of our prior U.S. application Ser. No. 215,412, filing date Dec. 11, 1980, now U.S. Pat. No. 4,376,747.

Thus invention relates to a mesophase pitch derived fiber and particularly to pitch and carbon fibers having predetermined cross-sectional structures.

Generally, the conventional process for producing a carbon fiber from mesophase pitch includes the steps of spinning a pitch fiber from the mesophase pitch by passing the mesophase pitch through a passageway or channel, thermosetting the pitch fiber, and thereafter, carbonizing the pitch fiber to produce the carbon fiber.

It is known that carbon fibers can possess different cross-sectional structures. The various cross-sectional structures are due to the crystallite orientation within the fiber and have been generally categorized by the visible appearance under magnification of the cross-section of the fiber.

In the article, "ELECTRON-MICROSCOPE STUDIES OF STRUCTURAL HETEROGENEITY IN PAN-BASED CARBON FIBRES" by S. C. Bennett and D. J. Johnson, *Carbon* Vol. 17, pp. 25–39 (1979) there is reported that for polyacrylonitrile (PAN) based carbon fibers the cross-sectional structures are generally either tangential or a weak radial core surrounded by a thin sheath of tangential structure. The article also suggests that differences in the mechanical properties of the PAN-based carbon fibers are related to the cross-sectional structure.

The expressions "radial structure", "tangential structure", "random structure" are descriptive of the physical appearance of the cross-sections on an enlarged scale. These structures have been observed in mesophase pitch derived carbon fibers and reported by J. B. Barr, S. Chwastiak, R. Didchenko, I. C. Lewis, R. T. Lewis, and L. S. Singer in *App. Poly. Sym.*, 29 pp. 161–173 (1976). In addition, the differences in the mechanical properties of mesophase pitch derived carbon fibers made from different precursor pitches have been attributed to the differences in the microstructure of the carbon fibers.

It is well known that the cross-sectional structure of a mesophase pitch fiber is generally preserved after the pitch fiber is carbonized to become a carbon fiber.

Prior art methods and apparatuses have not provided the flexibility of producing mesophase pitch fibers having predetermined cross-sectional structures. Thus, a comparative study could not be made easily to determine the relative advantages and disadvantages of carbon fibers having different cross-sections.

The instant invention allows a predetermined structure selection for a mesophase pitch fiber. Within the teachings herein, generally specific structures can be obtained. The variations in cross-sectional structure can be determined through straightforward experimentation to optimize the structure obtained to be reasonably similar to a predetermined cross-sectional structure.

As used herein, the term "pitch" is carbonaceous residue consisting of a complex mixture of primarily aromatic organic compounds derived from the thermal treatment of organic materials. Pitch is solid at room temperature and exhibits a broad melting or softening temperature range. When cooled from the melt, pitch is solidified without crystallization.

As used herein, the term "mesophase" is synonymous with liquid crystal; i.e., a state of matter which is intermediate between a crystal and an isotropic liquid. Ordinarily, a material in this state exhibits both anistropic and liquid properties.

Pitches can contain varying amounts of mesophase. The mesophase regions are recognized by the optical anisotrophy in the liquid state and the anisotropy is maintained in the solid state.

As used herein, the term "mesophase pitch" is a pitch containing at least 40% by weight mesophase. This is the minimum level for which a pitch is capable of forming a continuous anisotropic phase when dispersed by agitation or similar means.

As used herein, a "porous body" is a body possessing tortuous paths and is capable of maintaining its structural integrity under the conditions of temperature and pressure during the spinning of the mesophase pitch into a pitch fiber. Preferably, the porous body is a porous metal body. Methods of making porous bodies of various porosities are known. The porous body can be a porous ceramic or the like.

The porous body can be a separate element combined into the spinnerette or can be formed into a portion of the spinnerette in accordance with known methods.

Generally, the minimum thickness of the porous body as measured in the direction of the flow path should be sufficient to establish an effect on the cross-sectional structure of the pitch fiber being produced. For a porous metal body, a thickness of at least about 10 particles is needed for tortuous paths.

The maximum thickness of the porous body is somewhat related to the cross-sectional area of the porous body. The maximum thickness is determined by the pressure to be used on the mesophase pitch to produce the pitch fiber.

The porous body is positioned in the spinnerette channel through which the mesophase pitch flows to form the pitch fiber.

Generally, for a small channel, the particle size for a porous metal body should be greater than about 10 microns with about 30 volume % voids.

For a large channel, the particle size for a porous metal body is in the range of from about 100 to about 200 mesh with about 60 volume %. Generally, the particle size for a porous metal body is from about 5% to about 30% of the diameter of the exit side of the channel.

Preferably, the porous body is made in situ in the spinnerette channel using prior art methods.

Preferably, the porous body is a porous metal body made from 100/150 mesh particles having a size of about 0.007 inch. The porous body is made of about 80% by weight nickel and about 20% by weight chromium. The bonds between particles are about 10% of the particle size and pack to 60% volume with 45 microns average pore size. All of the pores are essentially open pores.

One of the principal embodiments of the invention is the process of producing a mesophase pitch derived carbon fiber, including the steps of spinning a pitch fiber from mesophase pitch using a spinnerette by passing the mesophase pitch through a spinnerette channel defined between the inside and outside surfaces of the spinnerette, thermosetting the pitch fiber, and thereafter, carbonizing the pitch fiber to produce the carbon fiber; and features the improvement comprising positioning a porous body in the spinnerette channel.

Another principal embodiment of the invention is the process of producing a mesophase pitch fiber including the spinning of mesophase pitch into a fiber using a spinnerette by passing the mesophase pitch through a spinnerette channel defined between the inside and outside surfaces of a spinnerette; and features positioning a porous body in the spinnerette channel.

Preferably, the porous body is porous metal and can be positioned in the channel near the inside surface of the spinnerette.

A preferred embodiment features the channel having a conical portion and yet another embodiment features the porous body being positioned in the conical portion.

Another principal object of the invention is the process of producing a carbon fiber from a mesophase pitch, including the steps of spinning a pitch fiber from the mesophase pitch using a spinnerette by passing the mesophase pitch through a spinnerette channel defined between the inside and outside surfaces of the spinnerette, thermosetting the pitch fiber, and thereafter, carbonizing the pitch fiber to produce the carbon fiber; and features the improvement of maintaining a roughened interior surface of the spinnerette channel in the vicinity of the outer surface of the spinnerette.

Yet another principal object of the invention is a spinnerette for spinning a pitch fiber from mesophase pitch, comprising a reservoir for the mesophase pitch, heating means for heating the mesophase pitch in the reservoir, pressing means for exerting pressure on the mesophase pitch, output means comprising a spinnerette channel through which mesophase pitch communicates from the reservoir to the outside of the spinnerette to form the pitch fiber, and a porous body positioned in the spinnerette channel.

It is important to realize in connection with the invention that the porous body is not functioning as a filter and that the porous body is not a substitute for filtering the mesophase pitch if such a filtering is appropriate. This can be appreciated by the fact that the use of a roughened interior surfae of the channel in the vicinity of the outside surface of the spinnerette is also an embodiment of the invention.

For a fuller understanding of the nature and objects of the invention, reference should be added to the following detailed description, taken in connection with the accompanying drawings, in which:

FIG. 1 shows a simplified apparatus, partially in section, is one embodiment of the instant invention;

FIG. 2A shows the invention corresponding to outlet means of FIG. 1 on an enlarged scale;

FIG. 2B shows a sketch of an observed cross-sectional structure of a pitch fiber produced using the outlet means of FIG. 2A;

Figure 3A:
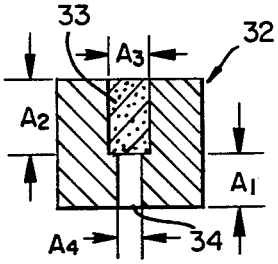

FIGS. 3A, 3B, 3C, and 3D show on an enlarged scale portions of additional outlet means of the invention; and FIGS. 4A, 4B, 4C, and 4D show sketches of observed structures of pitch fibers produced using the outlet means shown in FIGS. 3A, 3B, 3C, and 3D, respectively.

In carrying the invention into effect, certain embodiments have been selected for illustration in the accompanying drawings and for description in the specification. Reference is had to the drawings.

As shown in FIG. 1, a simplified spinning apparatus 10 for producing pitch fibers includes a piston 11 which applies pressure to liquid mesophase pitch 12 in reservoir 13. The mesophase pitch 12 has a Mettler softening point of about 322° C., and a mesophase content of about 77% by weight. The reservoir 13 is maintained at a temperature of about 339° C. by heating means not shown, in accordance with conventional practice.

The mesophase pitch 12 passes through a spinnerette or outlet means 14 including a spinnerette channel 16 to form a mesophase pitch fiber 17. The channel 16 extends from the inside to the outside of the spinnerette or outlet means 14.

Rollers 18 have diameters of about 1 inch and rotate with a speed of about 17 feet per minute and result in a drawn pitch fiber 19. A tray 21 is used to collect the pitch fiber 19.

Typically, the piston 11 is moved downward at a speed of about 0.6 cm per minute and the pitch fiber 19 has a diameter of less than about 60 microns. Preferably the plunger speed and/or the diameter of the channel 16 as well as the draw ratio can be modified in accordance with the prior art to obtain pitch fibers having diameters from about 20 microns to about 30 microns, the preferred range.

In accordance with conventional practice, the pitch fiber 19 is thermoset by heating it in air to a temperature from about 300° C. to 400° C. The thermostet pitch fiber is carbonized in an inert atmosphere at a temperature of about 1700° C. in accordance with conventional practice to produce a carbon fiber.

Figure 3B:
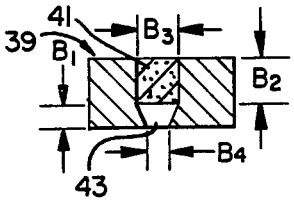

A porous body 22 of porous metal as shown in FIG. 2A was used in the embodiments of the FIGS. 3A, 3B, and 3C.

The enlarged sectional view of the outlet means 14 of FIGS. 1 is shown in FIG. 2A. The porous body 22 positioned in the spinnerette channel 16 of the mesophase pitch 12 of FIG. 1 and is spaced away from the exit opening 26 of the channel.

The porous body 22 is porous metal prepared in situ within the outlet means 14 in accordance with the prior art such as U.S. Pat. No. 3,831,258. Space 24 is due to the shrinkage of the materials used during the formation of the porous body 22. The porous body 22 was prepared using 100/150 mesh particles having a size of about 0.007 inch and made of about 80% nickel and about 20% chromium. The particles are irregular shaped particles and the bonds between particles were about 10% of the particle sizes. The particles packed to about 60 volume % with pores of 45 microns on the average. Essentially, all of the pores of the porous body 22 were open pores. Open pores are essential to pass the pitch through the spinnerette channel 16.

FIG. 2B shows the cross-sectional structure on an enlarged scale of a pitch fiber produced by the use of the outlet means 14 shown in FIG. 2A. Region 25 is generally a tangential structure, sometimes called an "onionskin" structure because its structure shows layers similar to the cross-section of an onion. Regions 27 and 28 have radial structures. Region 29 has a basal plane structural and region 31 has a small domain random structure.

Generally, the visually perceived tangential and radial structures are edge views of aromatic molecules which are favorably oriented substantially parallel to the pitch fiber axis. For the basal plane structure, the aromatic molecules generally lie in the cross-sectional plane so that the view in the direction of the pitch fiber axis is generally perpendicular to these aromatic molecules in the basal plane structure. The basal plane structure in pitch fibers has not been reported in the prior art.

Figure 4A:
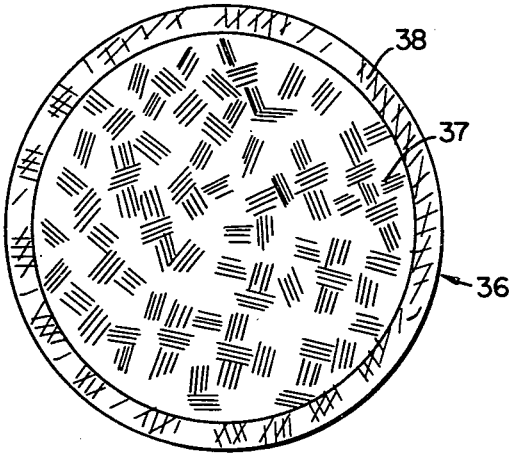

In FIG. 3A, outlet means 32 includes porous body 33 which has the same composition as the porous body 22, and is positioned spaced away from exit opening 34 of the spinnerette channel. The pertinent dimensions of the outlet means 32 are as follows: $A_1$ is about 0.46 inch, $A_2$ is about 0.7 inch, $A_3$ is about 0.25 inch, and $A_4$ is about 0.020 inch. FIG. 4A shows the cross-sectional structure of a mesophase pitch fiber 36 produced from the mesophase pitch 12 using the outlet means 32. A large domain random structure in region 37 is surrounded by a sheath of small domain random structure in region 38.

Figure 4B:
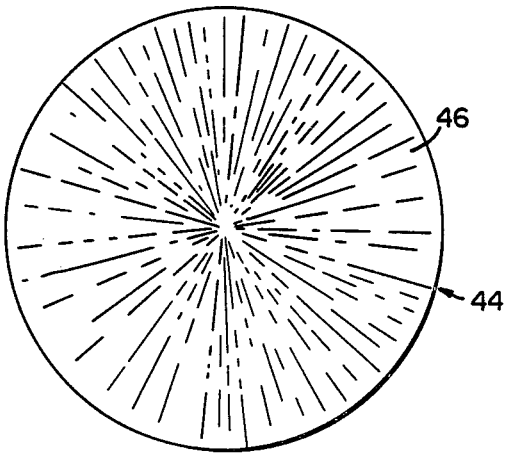

FIG. 3B shows outlet means 39 including porous body 41 which has the same composition as porous body 22 and is positioned spaced away from exit opening 43 of the spinnerette channel. The pertinent dimensions of the outlet means 39 are as follows: $B_1$ is about 0.20 inch, $B_2$ is about 0.40 inch, $B_3$ is about 0.25 inch, and $B_4$ is about 0.020 inch. The conical angle to exit opening 43 is about 60°. FIG. 4B shows the cross-sectional structure of a mesophase pitch fiber 44 produced from the mesophase pitch 12 using the outlet means 39. Region 46 is primarily a radial structure.

FIG. 3C shows outlet means 47 including porous body 48 which as the same composition as porous body 22 and is positioned in the conical portion near exit opening 49 of the spinnerette channel. The pertinent dimensions of the outlet means 47 are as follows: $C_1$ is about 0.20 inch, $C_2$ is about 0.40 inch, $C_3$ is about 0.25 inch, and $C_4$ is about 0.020 inch. The conical angle of the orifice 49 is about 60°. FIG. 4C shows the cross-sectional structure of a mesophase pitch fiber 51 produced from the mesophase pitch 12 using the outlet means 47. Region 52 is primarily a large domain random structure.

FIG. 3D shows outlet means 53 which includes a roughened interior surface 54 in the spinnerette channel. The surface 54 was produced by machining grooves approximately 0.0020 inch deep. The pertinent dimensions of the outlet means 53 are as follows: $D_1$ is about 0.20 inch, $D_2$ is about 0.40 inch, $D_3$ is about 0.25 inch, and $D_4$ is about 0.020 inch. The conical angle to exit opening 56 is about 60°. FIG. 4D shows the cross-sectional structure of a pitch fiber 57 produced from the mesophase pitch 12 using the outlet means 53. Region 58 is primarily a medium domain random structure.

I wish it to be understood that I do not desire to be limited to the exact details of construction shown and described, for obvious modifications will occur to a person skilled in the art.

What is claimed is:

1. A spinnerette for spinning a continous pitch fiber from mesophase pitch, comprising a reservoir for the mesophase pitch, heating means for heating the mesophase pitch in said reservoir, pressing means for exerting pressure on said mesophase pitch, outlet means comprising a spinnerette channel through which said mesophase pitch communicates from said reservoir to the outside of said spinnerette to form said pitch fiber, and a porous body positioned near the exit opening of said spinnerette channel.

2. The spinnerette of claim 1, wherein said porous body is a porous metal or a porous ceramic.

3. The spinnerette of claim 1, wherein said spinnerette channel has a conical portion.

4. The spinnerette of claim 3, wherein said porous body is positioned in said conical portion.

5. The spinnerette of claim 4, wherein said porous body is positioned adjacent to said conical portion.

* * * * *

UNITED STATES PATENT AND TRADEMARK OFFICE

CERTIFICATE OF CORRECTION

PATENT NO. : 4,480,977

DATED : November 6, 1984

INVENTOR(S) : Faramarz Nazem

It is certified that error appears in the above-identified patent and that said Letters Patent is hereby corrected as shown below:

Column 1, line 9, change "Thus" to --The--

Column 2, line 51, change "in situ" to --in situ--

Column 4, line 58, change "structural" to --structure--

Signed and Sealed this

Second Day of April 1985

[SEAL]

*Attest:*

DONALD J. QUIGG

*Attesting Officer*

*Acting Commissioner of Patents and Trademarks*